US007420107B2

(12) United States Patent
Parker et al.

(10) Patent No.: US 7,420,107 B2
(45) Date of Patent: Sep. 2, 2008

(54) MOLDED LAMINATE FOR MUSICAL INSTRUMENT AND METHOD OF MANUFACTURING MOLDED LAMINATE MUSICAL INSTRUMENT

(76) Inventors: Kenneth Parker, 25 Rockwood La., Gloucester, MA (US) 01930; Lawrence R. Fishman, 22 Calumet Rd., Winchester, MA (US) 01870

( * ) Notice: Subject to any disclaimer, the term of this patent is extended or adjusted under 35 U.S.C. 154(b) by 0 days.

(21) Appl. No.: 10/756,973

(22) Filed: Jan. 14, 2004

(65) Prior Publication Data

US 2006/0272470 A1 Dec. 7, 2006

Related U.S. Application Data

(60) Provisional application No. 60/439,952, filed on Jan. 14, 2003.

(51) Int. Cl.
*G10D 13/08* (2006.01)

(52) U.S. Cl. ..... 84/267

(58) Field of Classification Search ..... 84/267, 84/290, 291

See application file for complete search history.

(56) References Cited

U.S. PATENT DOCUMENTS

| | | | | |
|---|---|---|---|---|
| 5,125,312 A | | 6/1992 | Fishman et al. | 84/291 |
| 6,011,205 A | * | 1/2000 | Tucker et al. | 84/291 |
| 6,107,552 A | * | 8/2000 | Coomar et al. | 84/291 |

* cited by examiner

*Primary Examiner*—Kimberly R Lockett
(74) *Attorney, Agent, or Firm*—John Karl Buche

(57) ABSTRACT

A musical instrument, such as an electric or bass guitar, is formed of a lamination of wood layers having differing grain orientations in adjacent layers, the grain orientations defining a crossing angle less than 90°. An instrument formed from such a lamination is strong and resistant to splitting and checking and produces a good musical sound. The wood layers can be molded under pressure to form curves, such as an S-curve in a neck, or deformations, such as rounded edges in a guitar body. The S-curve in the neck allows the neck to be attached to the guitar body without breaking the continuity of the wood fibers, thereby strengthening the neck. In a three-dimensional molding embodiment, a net shape or near net shape part results, which requires little or no further machining after molding.

27 Claims, 8 Drawing Sheets

MOLDED LAMINATE FOR MUSICAL INSTRUMENT AND METHOD OF MANUFACTURING MOLDED LAMINATE MUSICAL INSTRUMENT

CROSS REFERENCE TO RELATED APPLICATIONS

Benefit is claimed under 35 U.S.C. § 119(e) of U.S. Provisional Application No. 60/439,952, filed Jan. 14, 2003, the disclosure of which is incorporated by reference herein.

STATEMENT REGARDING FEDERALLY SPONSORED RESEARCH OR DEVELOPMENT

N/A

BACKGROUND OF THE INVENTION

Musical instruments such as electric and bass guitars are made of wood. Solid wood is commonly used, as wood produces a good sound. Plywood has also been used, because of its strength. In plywood, layers of wood are glued together, with the grain angles alternating between a 0° orientation and a 90° orientation. An instrument of plywood, however, produces an inferior sound. Prior art composite neck structures for electric guitars are known that employ vertically oriented veneers in order to provide stiffness for resisting string tension.

SUMMARY OF THE INVENTION

The present invention relates to a musical instrument having improved strength while still producing a good musical sound. The musical instrument, such as an electric or bass guitar, is made of wood layers bonded with an appropriate resin in a mold to form a lamination. The wood layers are stacked with the grain orientations in adjacent layers differing. The grain orientations define a crossing angle less than 90°, preferably between 5° and 45°, and more preferably between 10° and 15°. An instrument formed from such a lamination is strong and resistant to splitting and checking while also producing a good musical sound.

The wood layers can be molded under pressure to form curves, such as an S-curve in a neck, or deformations, such as rounded edges in a guitar body. The wood layers are placed in an appropriate two-dimensional mold or three-dimensional mold in the proper order with the proper grain orientations. The layers can be placed in the mold dry, with resin to be introduced subsequently into the mold, or the layers can be wetted or roll coated with resin on one or both surfaces before placement in the mold, with or without subsequent further resin infusion.

In the two-dimensional molding embodiment, after molding, other features can be machined into the laminate. In this way, any desired number of model shapes can be machined from a standard molded blank. In the three-dimensional molding embodiment, a net shape or near net shape part results, which requires little or no further machining after molding.

A guitar formed with an S-curve in the neck allows the neck to be attached to the guitar body without breaking the continuity of the wood fibers, thereby strengthening the neck. By crushing or deforming the wood instead of adding more resin to round off abrupt or rough edges or contours, the amount of resin in the finished part is minimized and the amount of additional machining is also minimized or eliminated.

DESCRIPTION OF THE DRAWINGS

The invention will be more fully understood from the following detailed description taken in conjunction with the accompanying drawings in which.

DETAILED DESCRIPTION OF THE INVENTION

Figure 1D:
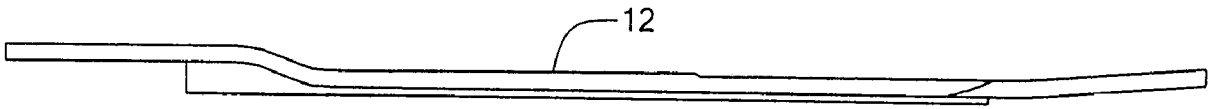
FIG. 1D is a side view of the neck of the bass guitar of FIG. 1A.
Figure 1A:
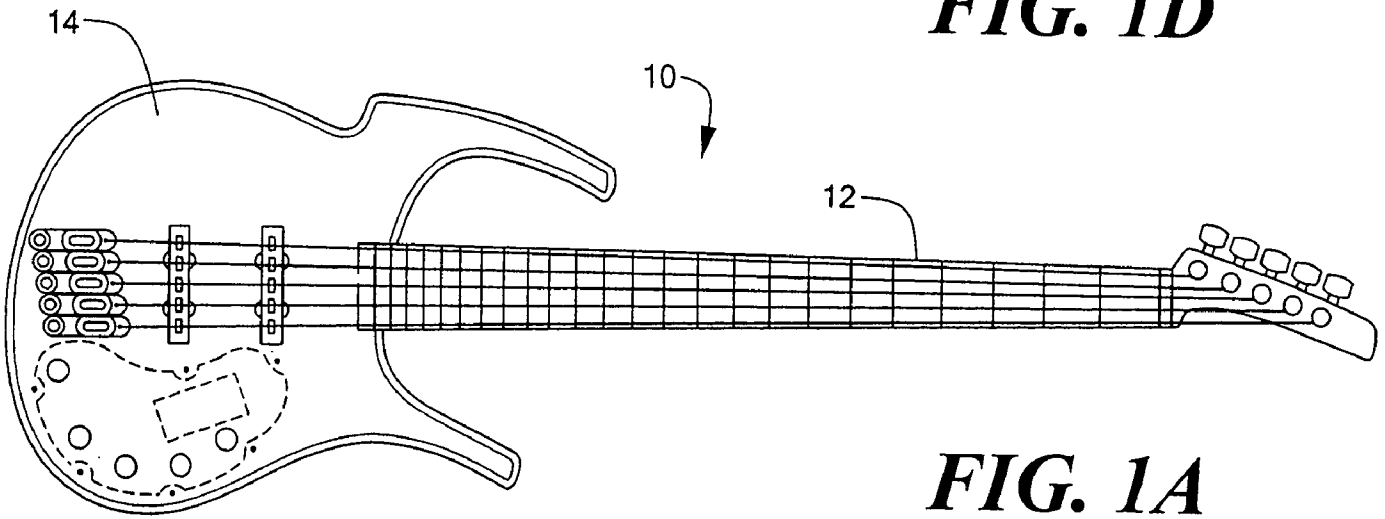
FIG. 1A is a top plan view of a solid body bass guitar according to the present invention.
Figure 1B:
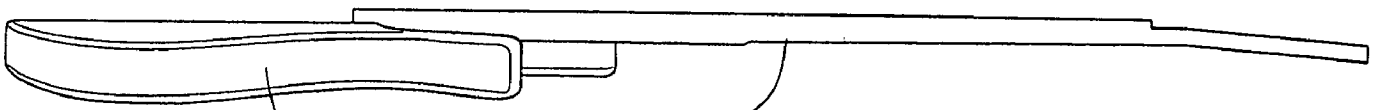
FIG. 1B is a side view of the bass guitar of FIG. 1A.
Figure 1C:
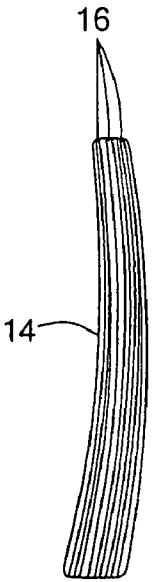
FIG. 1C is an end view of the bass guitar of FIG. 1A.
Figure 2:
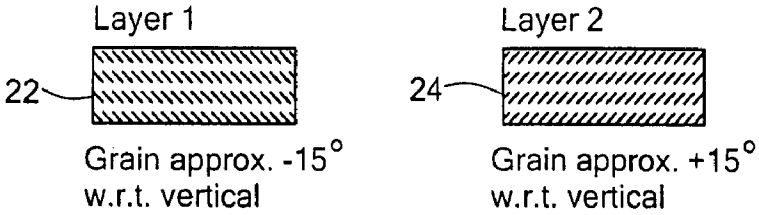
FIG. 2 is a schematic view of two layers illustrating different grain orientations.
Figure 3:
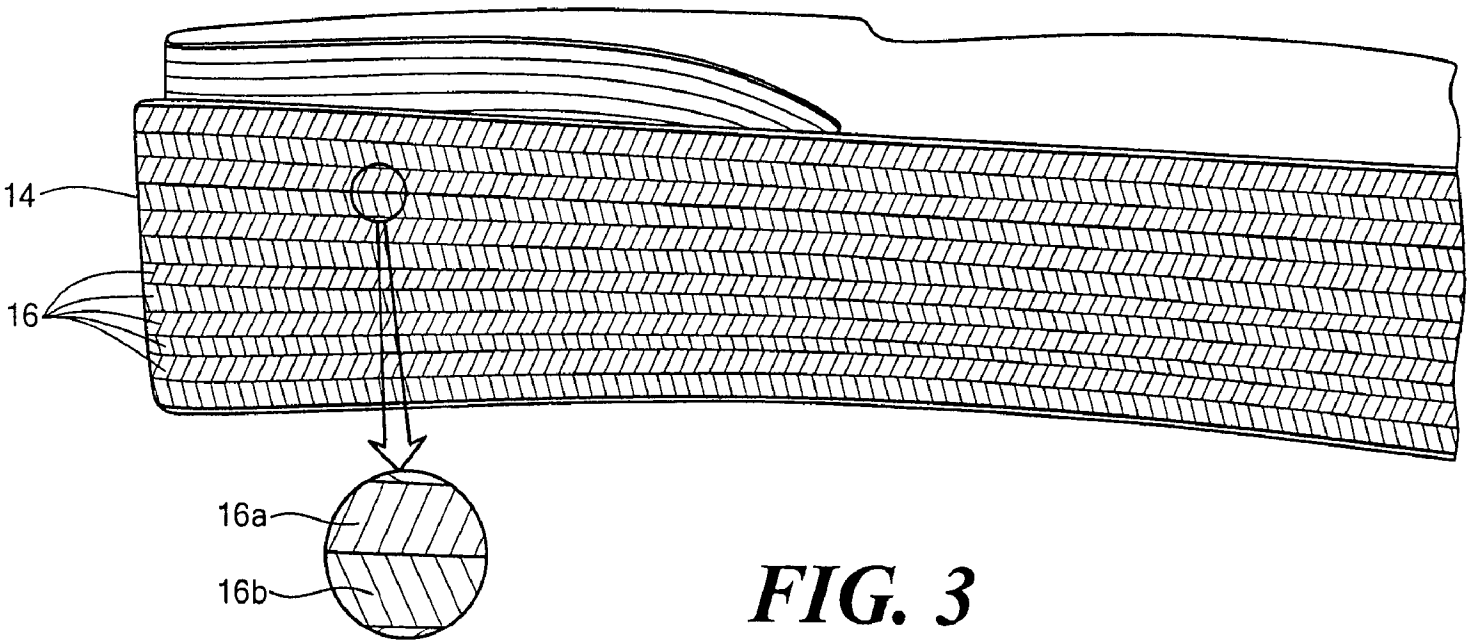
FIG. 3 is a partial side view of the guitar body FIG. 1A further illustrating different grain orientations in adjacent layers.

The present invention relates to a musical instrument, such as an electric or bass guitar made of wood layers bonded with an appropriate resin in a mold to form a lamination. A bass guitar 10 is illustrated in FIGS. 1A-1C. The neck 12 of the guitar is illustrated separately from the body 14 in FIG. 1D. The wood layers 16 are laminated together with the grain orientation between adjacent layers crossing at an angle less than 90°. Preferably, the crossing angle is between 5° and 45° and more preferably between 10° and 15°. For example, FIG. 2 illustrates schematically two layers, one layer 22 with its grain orientation at −15° with respect to vertical and the other layer 24 with its grain orientation at +15° with respect to vertical, resulting in a crossing angle of 30°. FIG. 3 shows a side view of the body 14 with an expanded portion further illustrating the different grain orientations of adjacent layers 16*a* and 16*b*. Wood can be considered a uni-directional material, because most of the fibers are oriented in the same direction. By varying the angle between the grain orientation of adjacent layers, the resulting lamination is not only strong and resistant to splitting or checking, but the wood also behaves sonically like solid wood, so that the finished instrument produces a good musical sound. The angle between the grain in one layer relative to a successive layer may be further adjusted in order to fine tune the trade-off between composite strength and mechanical resonance. A laminate stack with more than two grain orientations may be used.

Any wood can be used, although vertical grain softwoods are preferred. Vertical grain softwoods produce instruments with a good sound and are generally readily available. These woods also can be suitably deformed or crushed in the molding process of the present invention, described further below. Mahogany is also suitable. Similarly, any suitable resin can be used. An epoxy resin is preferred for its good mechanical properties.

Figure 4:
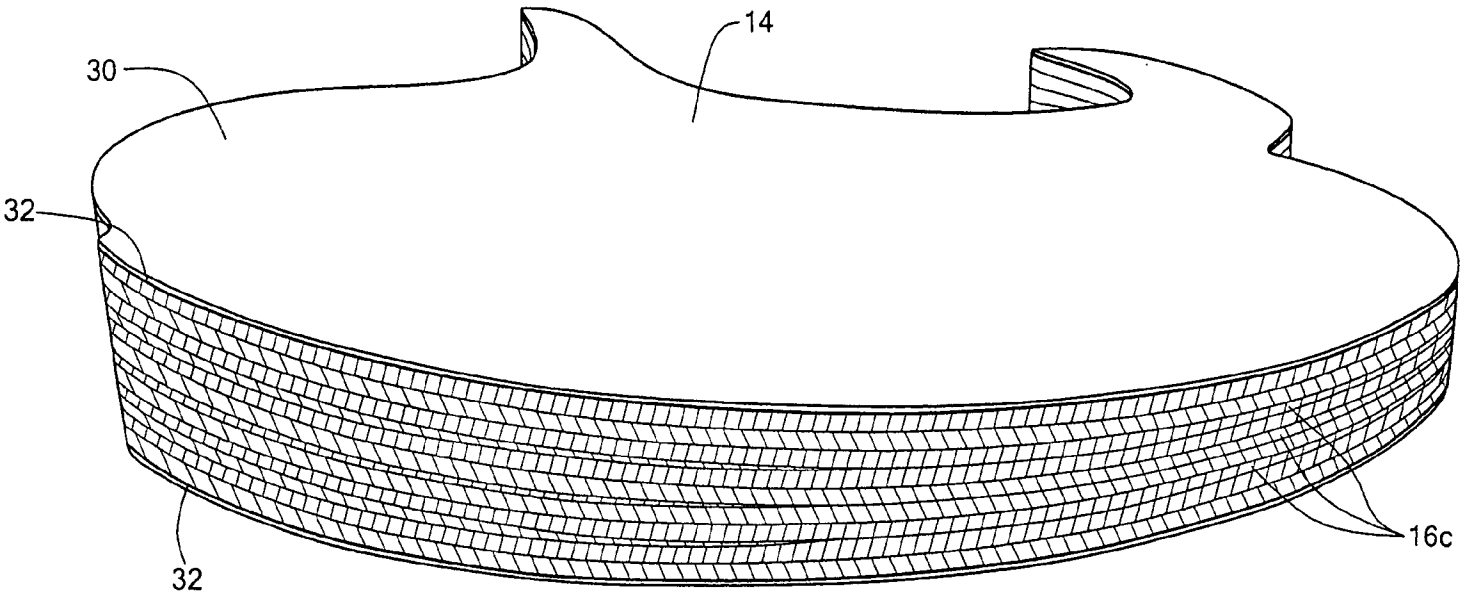
FIG. 4 is an end view of the guitar body of FIG. 1A illustrating tapered layers.
Figure 5:
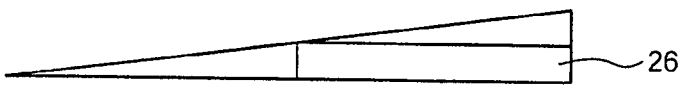
FIG. 5 is a schematic illustration of a tapered layer.

In the process of forming an instrument, a number of wood layers are cut, for example, by laser or die cutting, with the grain direction of each layer oriented to achieve a crossing angle in the resulting lamination as noted above. The layers could be flitch cut, although this is not necessary. The layers can have any suitable thickness. The thickness may be that of a veneer, ⅛ to 1/16 inch or less, or may be greater, up to 1 inch or even 2 inches. Some of the layers may be tapered in thickness across the grain. See, for example, layers 16*c* in FIG. 4. Tapering may be formed by cutting the layer with a taper or crushing an already cut layer to form a taper. Such tapering allows the thickness of a laminate stack to vary, to make a body that is thicker on one side than on the other. This may be done to reduce the volume of the instrument body to save weight. One tapered layer may include plural pieces of veneer, as illustrated schematically by the layer 26 in FIG. 5.

The wood layers are then placed in an appropriate two-dimensional mold or three-dimensional mold in the proper order. Generally, the guitar body and the guitar neck are cut and molded separately and joined together after molding. The body and neck could be cut and molded together if desired, however.

The layers can be placed in the mold dry, with no resin, or the layers can be wetted or roll coated with resin on one or both surfaces before placement in the mold. Other layers of sheet goods, such as paper, cardboard, plastic, cloth, or decorative veneer, may also be provided. For example, outer decorative veneer layers are usually placed on the top surface and bottom surface of a guitar body. See, for example, top veneer layer 30 in FIG. 4. The decorative veneer layer may be spaced from the interior wood layers with a layer of cross banding 32 to provide stability and a good surface of even thickness to which the veneer and the underlying layer may readily bond. The cross banding may be of any suitable material, such as vulcanized paper or a woven or nonwoven cloth, as would be known in the art.

Figure 6A:
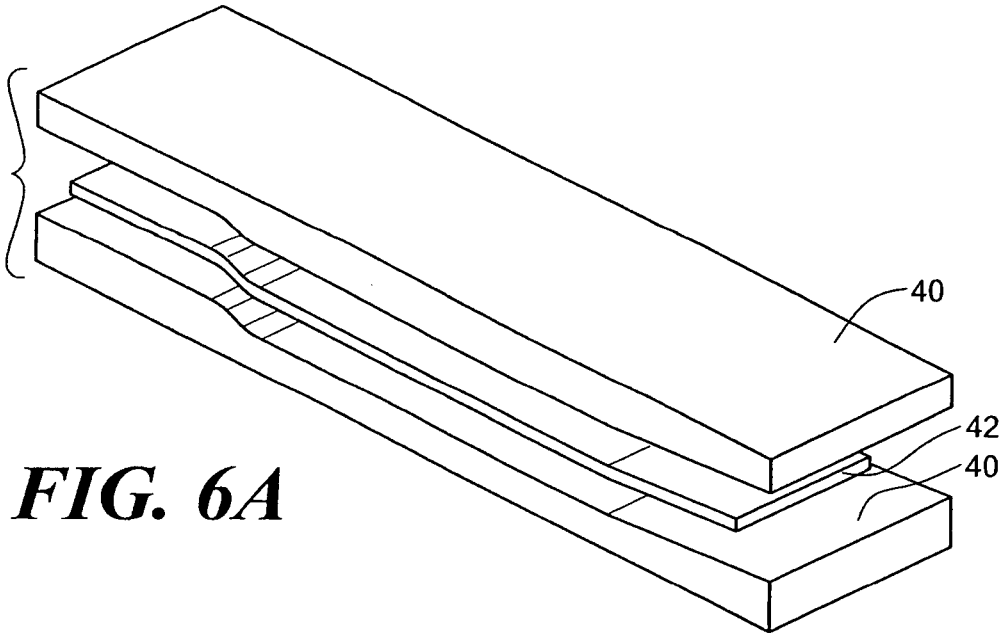
FIG. 6A is an exploded isometric view of curved platens for molding a neck blank with an S bend.

In a two-dimensional mold embodiment, press tooling is used to form a rectangular platform. The layered materials, wetted with an appropriate resin, are pressed between flat platens. Alternatively, as shown in FIG. 6A, curved platens 40 can be provided, for example, to form a curve in the layered body 42, such as an S-shaped bend for a neck.

Figure 6B:
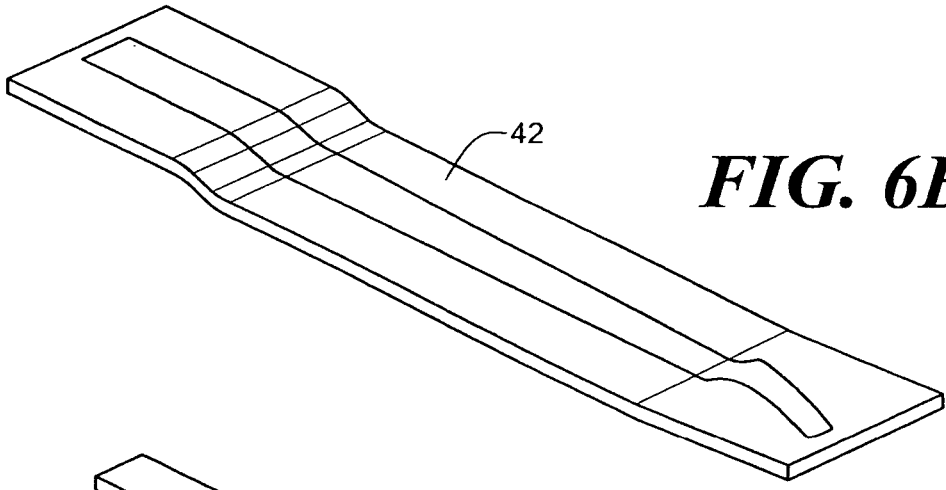
FIG. 6B is an isometric view of the neck blank of FIG. 6A.
Figure 6C:
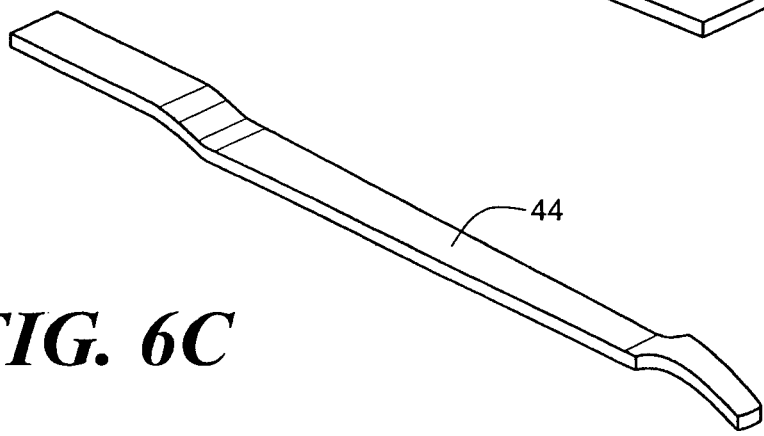
FIG. 6C is a neck machined from the neck blank of FIG. 6B.

Press molding provides great design flexibility. Any desired outline shape can be cut into the layers of wood. After molding, other features can be machined into the laminate by any known machining method. In this way, any desired number of model shapes can be machined from a standard molded blank. For example, in FIGS. 6B and 6C, a neck 44 is machined from the molded blank 42.

Figure 7A:
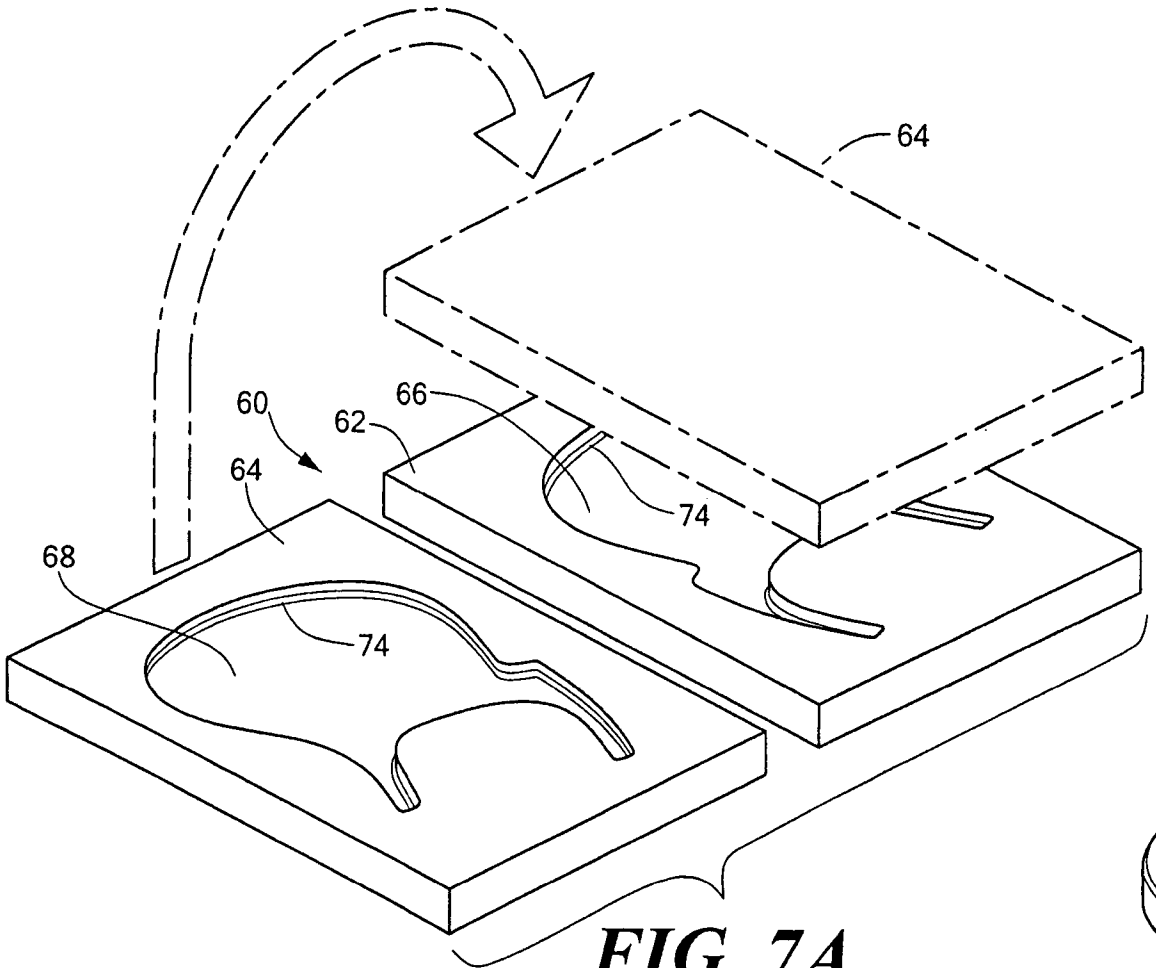
FIG. 7A is an exploded isometric view of a three-dimensional mold for molding a guitar body.
Figure 7B:
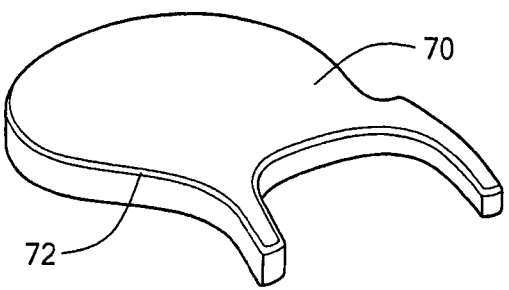
FIG. 7B is an isometric view of a near net shape guitar body produced in the mold of FIG. 7A.

In a further net or near net shape molded, or three-dimensional molding, embodiment, the laminate materials are precut with a desired outline and other features and placed in a two or more part mold. FIG. 7A shows a two part mold 60 for a guitar body 50 having a bottom piece 62 and a top piece 64. The top piece 64 is also illustrated in phantom turned over into a position to close the mold. Cavities 66, 68 are formed in both mold pieces in the shape of the finished part. The cavity surfaces may be smooth or textured, if desired to impart a particular surface to the part. The laminate stack, precut to fit in the cavities 66, 68 is laid therein. Resin may be introduced either before closing the mold or the mold may be infused with resin after the mold is closed. A net shape or near net shape part 70 results. See FIG. 7B. Thus, this process produces an instrument that needs little or no further machining or cutting after molding.

Figure 8:
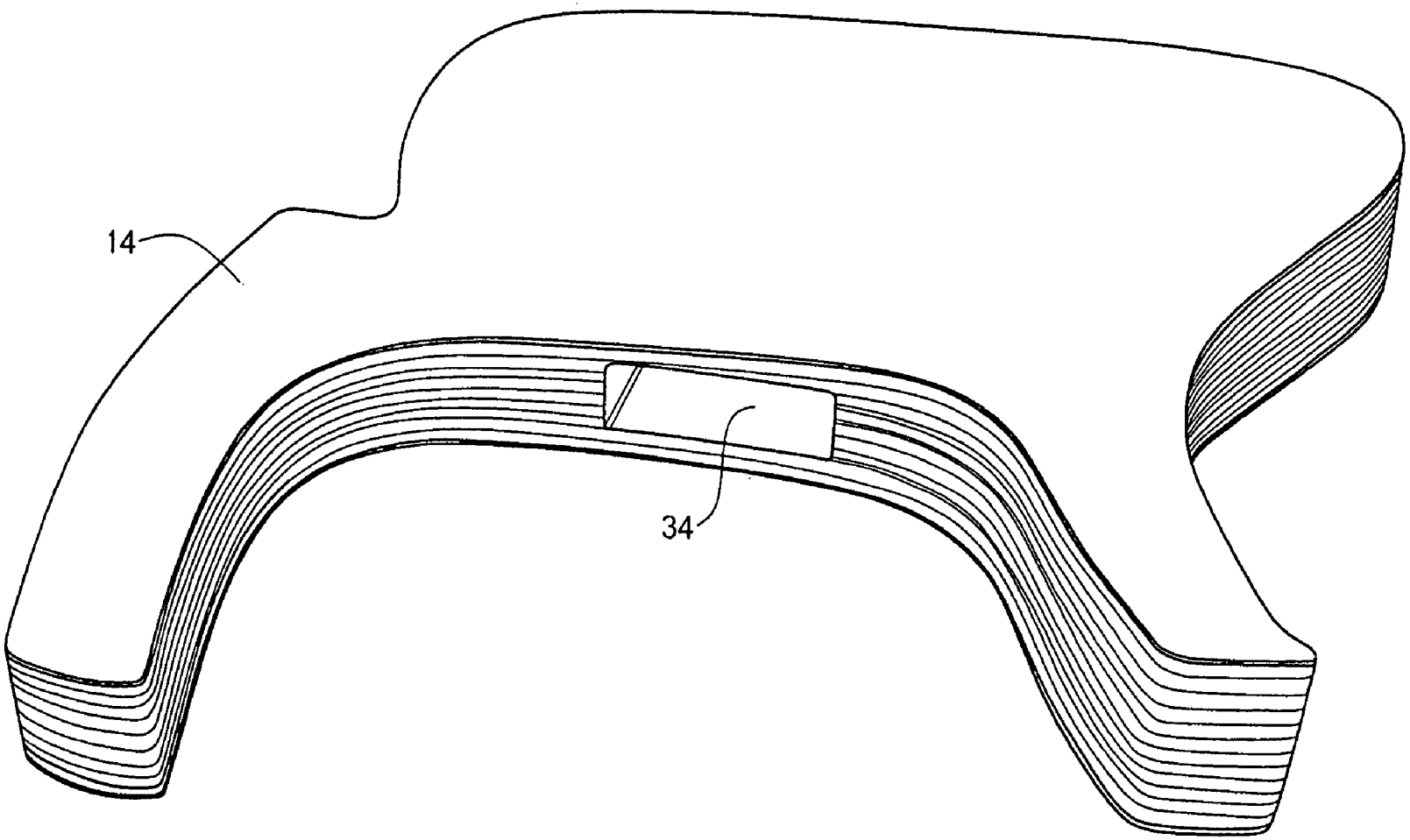
FIG. 8 is a perspective view of a guitar body illustrating a recess or pocket for a neck tongue.

The three-dimensional mold may incorporate various cores, which can form precise pockets and hollows for the purpose of housing various components, such as the neck tongue, the bridge, electromagnetic pickups, controls, circuits boards and batteries. The individual layers of the laminate stack are cut as appropriate to accommodate such cores. The cores are treated to enable release from the composite structure once pressed. FIG. 8 illustrates a recess or pocket 34 for the neck tongue.

If resin is introduced into the closed mold, such as in an injection molding or resin transfer molding process, the resin is forced into the mold under sufficient pressure to penetrate all the voids and between all the layers of wood in the mold. Vacuum assisted resin transfer can also or alternatively be used. Preferably, the mold is heated to speed the resin cure time, as known in the art. The viscosity of the resin should allow the resin to flow and penetrate all the voids and between the layers.

In another aspect of the invention, deformation molding is employed. Under high pressures, the flat materials may be deformed or crushed in the mold into compound curves. Such deformation or crushing can create design features that are desirable for surface interest and that also may have further ergonomic benefits. For example, the rounding over of the edges 72 of a guitar body (see FIG. 7B), which would normally be done after molding with machine tools and sandpaper, can be accomplished by stacking the layers fairly tightly in a mold with correspondingly shaped inner corners 74. Thus, the proper design of press molds may substantially minimize labor intensive post-processing.

The resin to fiber ratio can be minimized by use of deformation molding. By crushing or deforming the wood instead of adding more resin to round off otherwise abrupt or rough edges or contours, the amount of resin in the finished part is minimized. Ideally, just enough resin is used to fill the small voids between the solid materials and to bond the laminates.

The mold may also be cooled to cool the finished part before it is removed from the mold. The molded part emerges with a finished surface, which may be smooth or textured. The surface may be further treated by painting, electroplating, or texturing by abrasion, bead blasting, or in any other suitable manner, as will be appreciated by those in the art.

Figure 9A:
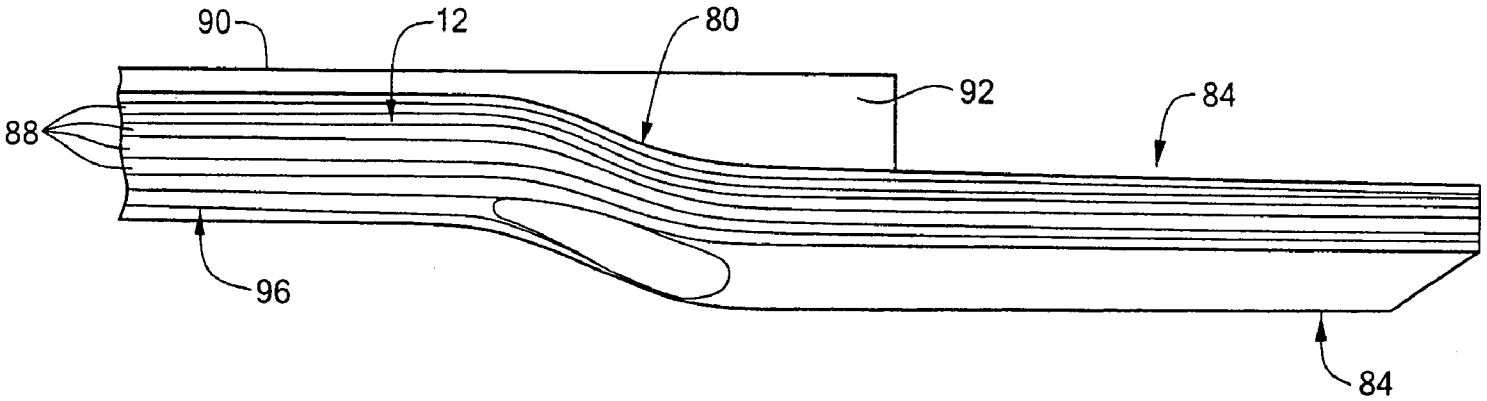
FIG. 9A is a partial side view of the lower portion of a neck incorporating an S bend.
Figure 9B:
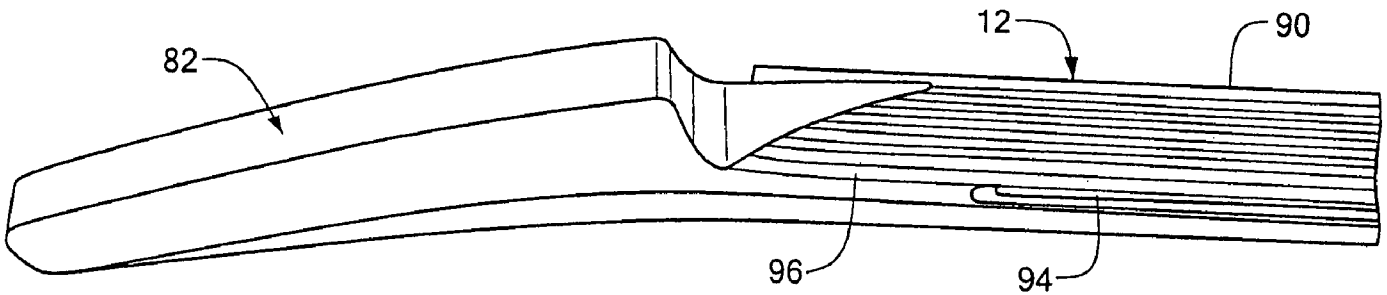
FIG. 9B is a partial side view of the upper portion of the neck of FIG. 9A.
Figure 10D:
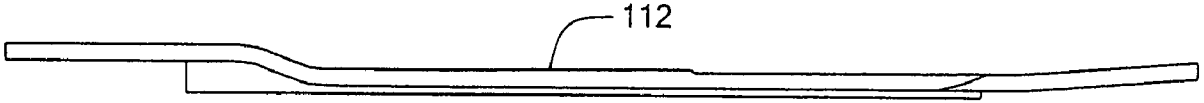
FIG. 10D is a side view of the neck of the bass guitar of FIG. 10A.
Figure 10A:
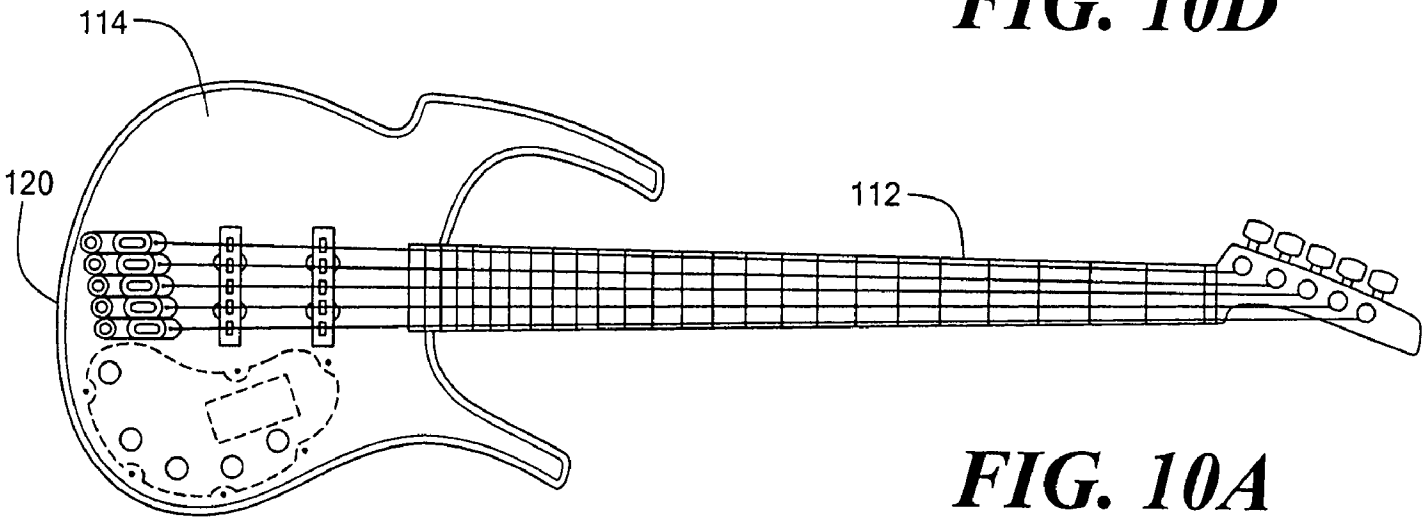
FIG. 10A is a top plan view of a hollow body bass guitar according to the present invention.
Figure 10B:
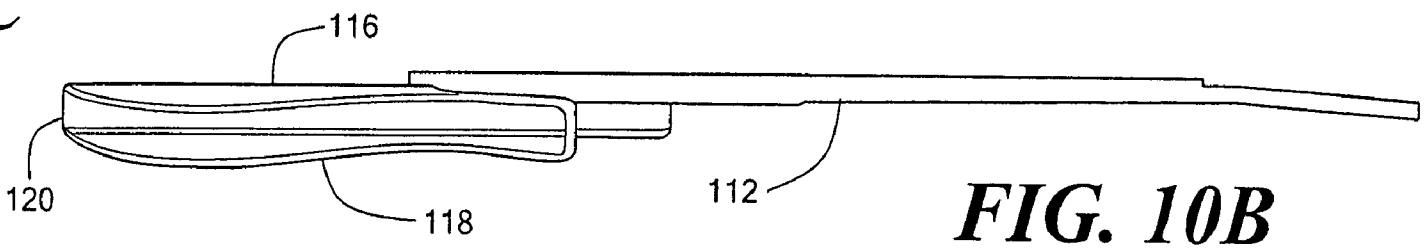
FIG. 10B is a side view of the guitar of FIG. 10A.
Figure 10C:
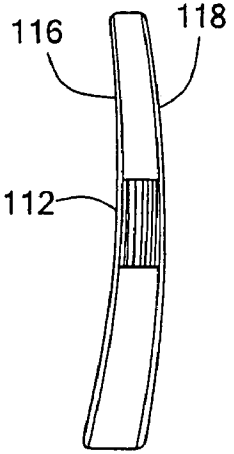
FIG. 10C is an end view of the guitar of FIG. 10A.

FIGS. 9A and 9B illustrate with more particularity the neck 12 for a guitar incorporating an S bend 80 formed using the curved platens described above. The neck extends from the head stock 82 (FIG. 9B) to a tongue 84 at the lower extent 86 that fits into the corresponding molded pocket 34 or a machined recess in the guitar body 14. The tongue sets the neck angle relationship to the body. The neck may be attached by bonding, mechanical fasteners, or simply by resting in a molded socket in the body and held in place by string tension. A number of wood layers 88 are arranged horizontally with the grain orientation of adjacent layers alternating as described above. Thus, there is no layer-to-layer matching of grain angle, improving the overall resistance to fracture in the composite product and the stability and strength of the laminated neck blank. Additional strengthening layers such as carbon fiber cloth on the back surface of the neck and head stock can also be used.

The offset S bend or S curve 80 keeps the wooden fibers of the layers 88 continuous, as otherwise machining the pockets for the electromagnetic pickups would sever them. The neck is then cut from the blank. A top surface 90 and filler piece 92 curved to match the S curve are bonded to the neck. A truss rod slot 94 is machined in the back surface 96 and the back surface is rounded.

In prior art solid body instruments, the neck can be mechanically interfaced to the body of the instrument in a variety of ways. For instance, the neck may extend only a limited distance into a groove on a rear surface of the body with mechanical fasteners such as screws used to attach the neck to the body. In another embodiment, a longer neck extension projects into a recess in the top end of the body. Most solid body, stringed musical instruments employ magnetic pickups. A recess must be formed in the front surface of the body to accommodate such a pickup. With a neck extension protruding into the body in this second attachment arrangement, the neck extension also has to be cut to accommodate the pickup. Both of these prior art approaches result in a minimized mechanical interface between the neck and the body. The present invention compensates for these limitations by providing the S-shaped bend in the neck proximate the body. The fibrous layers are thus made continuous along the length of the neck, adding significantly to the overall strength of the neck. The neck may then be disposed in a recess in the top of the body, or may be attached to a major portion of the rear of the body, but without the concern that providing for pickups will weaken the mechanical interface.

The neck may also be externally reinforced with a further fiber strengthening layer saturated and bonded with a suitable resin. The fiber layer can be of any suitable fibers, such as carbon or glass. Multiple layers can be provided. The fibers can be provided in any suitable layered form, such as a woven or nonwoven cloth. If the fibers are aligned, multiple layers can be provided with offset axes of alignment to improve mechanical rigidity. The minimal amount of resin is used, as resin tends to be less mechanically responsive than certain woods.

In a further three-dimensional molding embodiment, the neck materials, including an adjustable truss rod, may be precut and loaded in a two or more part mold. Laminating resin may be either introduced before closing the mold or infused into the mold after it is closed, rendering a net shaped part. The resulting molded part may have a smooth or textured finished surface, which may be further treated, as described above.

The methods of the present invention can be used to create parts for solid body instruments or to make thin laminates having as few as two layers for new types of instruments. For example, two separate thin laminates may be used to form a hollow body structure of enhanced strength and desired tone. Instruments constructed in this way have characteristics of both solid and hollow bodied instruments. One embodiment, illustrated in FIGS. 10A-10D, utilizes a composite neck structure 112 as described above that extends to the point 120 at which the instrument body terminates. In this embodiment, the body 114 itself is comprised of thin laminate top and bottom surfaces 116, 118 disposed on opposing sides of the extended neck. Spacer blocks may be provided to enhance the rigidity of the laminates. While magnetic pickups could be disposed through the top laminate layer and into the extended neck, it would be preferred to employ piezoelectric transducers in the instrument's bridge to avoid the removal of material from the top laminate and the extended neck, potentially weakening the instrument.

The invention is not to be limited by what has been particularly shown and described, except as indicated by the appended claims.

What is claimed is:

1. A method of manufacturing a musical instrument comprising: forming a plurality of layers of wood into a stack, with a grain orientation of adjacent layers differing, the grain orientations defining a crossing angle, the crossing angle between adjacent layers less than 90°; and molding the stack with a resin in a mold to form a lamination comprising at least a portion of the musical instrument, and wherein the molding step, molding the stack in a closed mold having a cavity therein, wherein the cavity in the closed mold has a shape corresponding to the portion of the musical instrument, and cutting the plurality of layers into the shape of the portion of the musical instrument prior to forming the plurality of layers into the stack.

2. The method of claim 1, wherein the mold cavity is shaped to deform a portion of the stack and further comprising loading the stack into the mold tightly to be deformed by the mold cavity.

3. The method of claim 2, wherein the mold cavity includes rounded corners shaped to deform edges of the stack to impart a rounded edge to the musical instrument.

4. A method of manufacturing a musical instrument comprising: forming a plurality of layers of wood into a stack, with a grain orientation of adjacent layers differing, the grain orientations defining a crossing angle, the crossing angle between adjacent layers less than 90°; and molding the stack with a resin in a mold to form a lamination comprising at least a portion of the musical instrument, and in the molding step, molding the stack between platens.

5. The method of claim 4, further comprising imparting a curve to the stack by using curved platens.

6. The method of claim 5, further comprising imparting an S-shaped curve to the stack.

7. The method of claim 4, further comprising machining the lamination to a shape corresponding to the portion of the musical instrument.

8. A method of manufacturing a musical instrument comprising: forming a plurality of layers of wood into a stack, with a grain orientation of adjacent layers differing, the grain orientations defining a crossing angle, the crossing angle between adjacent layers less than 90°; and molding the stack with a resin in a mold to form a lamination comprising at least a portion of the musical instrument, and wetting the plurality of layers with a resin prior to the molding step.

9. A method of manufacturing a musical instrument comprising: forming a plurality of layers of wood into a stack, with a grain orientation of adjacent layers differing, the grain orientations defining a crossing angle, the crossing angle between adjacent layers less than 90°; and molding the stack with a resin in a mold to form a lamination comprising at least a portion of the musical instrument, and infusing resin into the stack during the molding step.

10. A method of manufacturing a musical instrument comprising: forming a plurality of layers of wood into a stack, with a grain orientation of adjacent layers differing, the grain orientations defining a crossing angle, the crossing angle between adjacent layers less than 90°; and molding the stack with a resin in a mold to form a lamination comprising at least a portion of the musical instrument, and wherein the wood layers comprise a vertical grain softwood.

11. A method of manufacturing a musical instrument comprising: forming a plurality of layers of wood into a stack, with a grain orientation of adjacent layers differing, the grain orientations defining a crossing angle, the crossing angle between adjacent layers less than 90°; and molding the stack with a resin in a mold to form a lamination comprising at least a portion of the musical instrument, wherein at least a portion of the wood layers are tapered.

12. A method of manufacturing a musical instrument comprising: forming a plurality of layers of wood into a stack, with a grain orientation of adjacent layers differing, the grain orientations defining a crossing angle, the crossing angle between adjacent layers less than 90°; and molding the stack with a resin in a mold to form a lamination comprising at least a portion of the musical instrument, wherein the resin comprises an epoxy resin.

13. An electric guitar formed by a method of manufacturing a musical instrument comprising: forming a plurality of layers of wood into a stack, with a grain orientation of adjacent layers differing, the grain orientations defining a crossing angle, the crossing angle between adjacent layers less than 90°; and molding the stack with a resin in a mold to form a lamination comprising at least a portion of the musical instrument.

14. A bass guitar formed by a method of manufacturing a musical instrument comprising: forming a plurality of layers of wood into a stack, with a grain orientation of adjacent layers differing, the grain orientations defining a crossing angle, the crossing angle between adjacent layers less than 90°; and molding the stack with a resin in a mold to form a lamination comprising at least a portion of the musical instrument.

15. An electric stringed musical instrument comprising: a body, the body comprising a laminated stack of wood layers, including a recess formed in a top edge; a neck comprising a laminated stack of wood layers, an S-shaped bend formed in the wood layers, a lower extent of the neck forming a tongue received in the recess in the body, the neck further comprising a head and an upper surface on the stack of wood layers extending from the head to a tongue and overlying the S-shaped bend.

16. The electric stringed musical instrument of claim 15, wherein the instrument comprises an electric guitar.

17. The electric stringed musical instrument of claim 15, wherein the instrument comprises a bass guitar.

18. An electric stringed musical instrument comprising: a body comprising a laminated stack of wood layers, adjacent layers having differing grain orientations, the grain orientations defining a crossing angle, the crossing angle less than 90°; and a neck attached to the body, the neck comprising a laminated stack of wood layers, adjacent layers having differing grain orientations, the grain orientations defining a crossing angle less than 90°.

19. The electric stringed musical instrument of claim 18 wherein the crossing angles are between 5° and 45°.

20. The electric stringed musical instrument of claim 18, wherein the crossing angles are between 10° and 15°.

21. The electric stringed musical instrument of claim 18, wherein the instrument comprises an electric guitar.

22. The electric stringed musical instrument of claim 18, wherein the instrument comprises a bass guitar.

23. An electric guitar formed by a method of manufacturing a musical instrument comprising: providing a stack of wood layers; molding the stack of wood layers between curved platens to impart an S-shaped bend to a portion of the stack with wood fibers maintained continuous along the S-shaped bend and to form a lamination comprising a neck of the musical instrument; and attaching the neck to a body of the musical instrument.

24. A bass guitar formed by a method of manufacturing a musical instrument comprising: providing a stack of wood layers; molding the stack of wood layers between curved platens to impart an S-shaped bend to a portion of the stack with wood fibers maintained continuous along the S-shaped bend and to form a lamination comprising a beck of the musical instrument; and attaching the neck to a body of the musical instrument.

25. An electric guitar formed by a method of manufacturing a musical instrument comprising: cutting a plurality of wood layers into a shape of a body of a musical instrument; stacking the wood layers into a stack; molding the stack of wood layers in a mold cavity having rounded internal corners, the stack of wood layers loaded in the cavity, whereby rounded edges are formed on the stack of wood layers, to form a lamination comprising a body of the musical instrument and attaching a neck to the body of the musical instrument.

26. A bass guitar formed by a method of manufacturing a musical instrument comprising: cutting a plurality of wood layers into a shape of a body of a musical instrument; stacking the wood layers into a stack; molding the stack of wood layers in a mold cavity having rounded internal corners, the stack of wood layers loaded in the cavity, whereby rounded edges are formed on the stack of wood layers, to form a lamination comprising a body of the musical instrument and attaching a neck to the body of the musical instrument.

27. A method of manufacturing a musical instrument comprising: forming a plurality of layers of wood into a stack, with a grain orientation of adjacent layers differing, the grain orientations defining a crossing angle, the crossing angle between adjacent layers less than 90°; and molding the stack with a resin in a mold to form a lamination comprising at least a portion of the musical instrument wherein the portion of the musical instrument comprises a body and a neck of the musical instrument.

* * * * *